United States Patent [19]

Michalak

[11] 4,002,136

[45] Jan. 11, 1977

[54] MARINE EXHAUST SYSTEM

[75] Inventor: Jerome M. Michalak, Cocoa Beach, Fla.

[73] Assignee: Ray Industries, Inc., Phoenix, Ariz.

[22] Filed: Oct. 14, 1975

[21] Appl. No.: 621,779

[52] U.S. Cl. ..... 115/.5 E; 9/6 P; 181/39; 60/310

[51] Int. Cl.[2] ..... B63H 21/32

[58] Field of Search ..... 115/.5 E; 9/6 P; 60/221, 310; 181/39

[56] References Cited

UNITED STATES PATENTS

| | | | |
|---|---|---|---|
| 2,713,841 | 7/1955 | Forbes | 114/183 R |
| 3,162,171 | 12/1964 | Willy | 115/.5 E |
| 3,198,162 | 8/1965 | Larsen | 60/310 X |
| 3,342,032 | 9/1967 | Cox et al. | 60/221 |
| 3,371,645 | 3/1968 | Ward | 115/.5 E |

*Primary Examiner*—Stephen G. Kunin
*Assistant Examiner*—Gregory W. O'Connor
*Attorney, Agent, or Firm*—Drummond, Nelson & Ptak

[57] ABSTRACT

A marine exhaust system for boats powered by an internal combustion engine is disclosed. An exhaust chamber is located in the stern of the boat and is connected to the engine exhaust manifold. A submerged exhaust port emits exhaust gases below the water level to silence exhaust noise. The exhaust port has a recessed opening so that relative movement of water past the port assists in drawing the exhaust gases from the chamber. Atmospheric vent holes communicate the chamber with atmosphere to exhaust gases when the boat is idling or operating at slow speeds.

3 Claims, 3 Drawing Figures

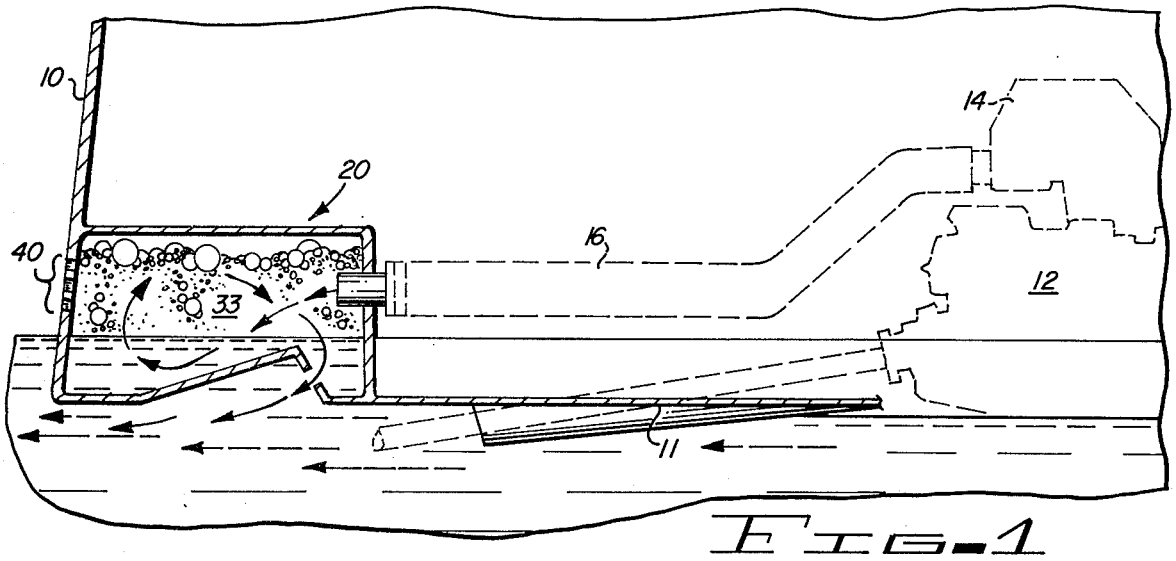
FIG. 1
FIG. 2
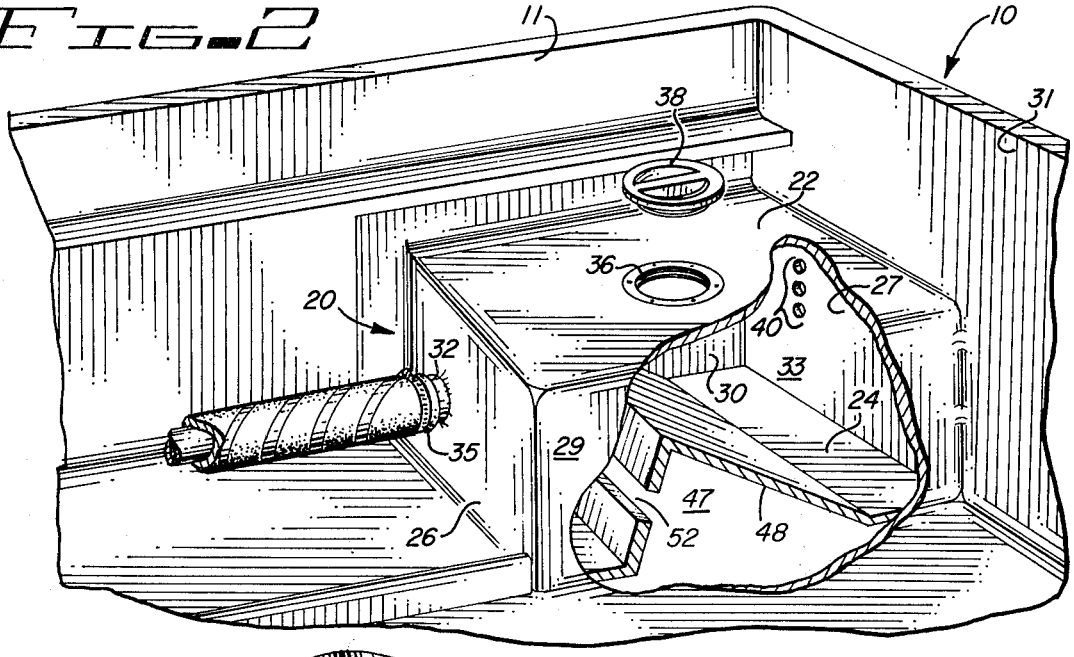
FIG. 3
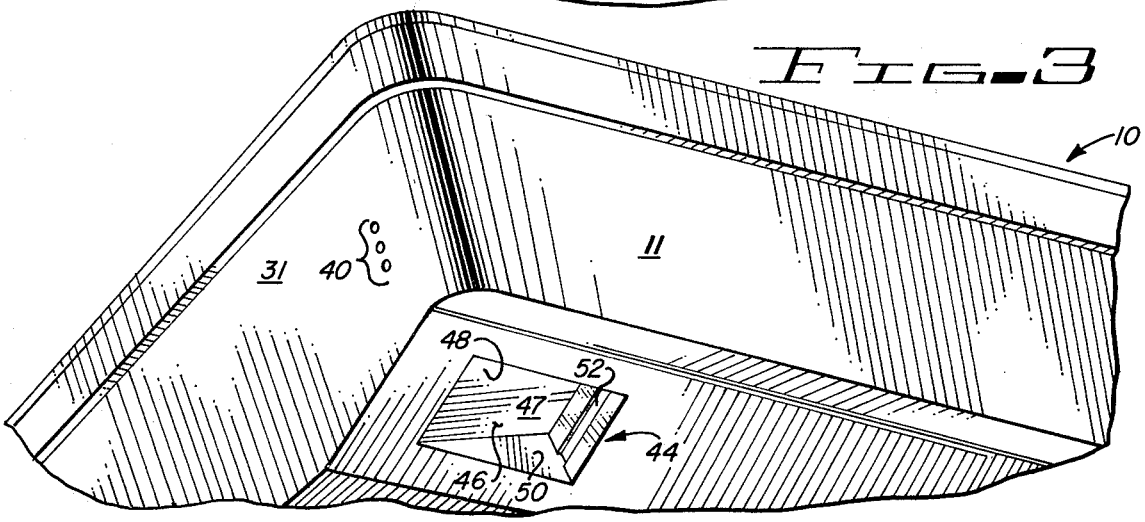

MARINE EXHAUST SYSTEM

BACKGROUND OF THE INVENTION

This invention relates to an exhaust system for an internal combustion engine and more particularly relates to an exhaust system for marine engines.

In-board mounted marine engines conventionally are provided with some means of reducing the sound levels associated with the operation of internal combustion engines. With the increased popularity of boating, it has become even more important to reduce the noise levels attendant to the operation of water craft. Unnecessary noise detracts from the pleasure of boating and can be an annoyance to the boat occupants and others in the area. Further, regulations imposed by various local, state and federal agencies are becoming more stringent in establishing maximum acceptable noise levels.

In an effort to comply with these regulations and requirements various exhaust silencing systems have been developed. Conventional exhaust mufflers can be installed in the exhaust pipe of the boat engine. Exhaust mufflers to be efficient as sound silencers, must decrease exhaust gas velocity and absorb the sound waves or cancel them by interference with other waves from the same source. Mufflers typically should have a volume of approximately 6 to 8 times the engine displacement and may further contain baffles to reduce the velocity across the muffler. In such systems exhaut back pressure should be kept to a minimum since increased back pressure will have a detrimental effect on the maximum power output of the engine and will cause increased engine wear.

It has also been suggested in the prior art to provide for the escape of exhaust gases from boats beneath the water level. The water serves to decrease exhaust gas velocity and absorbs the sound waves operating as an effective muffler. Most systems of this type terminate the exhaust pipe from the engine at a location beneath the boat so that in operation exhaust gases are discharged below the water level. By exhausting escaping gases beneath the boat the sound of exhaust is effectively muffled and gases are prevented from escaping into the air to the annoyance of the occupants of the boat. It is also known to incorporate a check valve at the terminal end of the exhaust pipe to prevent water from entering into the exhaust system. The pressure of the exhaust gases serves to open the check valves when the engine is started. Systems of this general type are found to be effective, however, they do not always reduce noise levels to an acceptable minimum. Further, systems of this type, particularly those including a check valve, may result in unacceptable increases and back pressure therefore reduce the power output of the engine. Performance may be particularly adversely effected when the boat engine is idling and the boat is not underway but is still in the water. In this condition back pressure can impose considerable load on the engine.

It has also been suggested in the prior art to incorporate a directional exhaust flow regulator in boats having internal combustion engines. The regulator conducts exhaust gases to the atmosphere when the boat is not moving and directs the exhaust gases beneath the water when the boat is underway. Such devices while effective, involve complicated valving arrangements requiring frequent maintenance and which are expensive in initial first cost.

SUMMARY OF THE INVENTION

Briefly, the present invention comprehends an exhaust system for marine engines. The exhaust system includes an exhaust chamber preferably integrally constructed in the hull of the boat having a common wall with the transom of the boat. The chamber is in communication with the exhaust manifold of the engine by a conventional exhaust pipe. A series of small relief holes or vents communicate the chamber with atmosphere at a location which is above the normal water line of the boat. An exhaust opening is provided in the bottom wall of the chamber and is recessed above the hull line. When the boat engine is idling or the boat is operating at a low speed, exhaust gases are vented directly to the atmosphere through the vent holes. When the boat is underway, exhaust gases are drawn into the chamber and are exhausted at the exhaust opening beneath the water level. The passage of water along the boat's hull and across the exhaust opening serves to create a siphon effect and a non-restricted exhaust flow to reduce back pressure on the engine. These and other advantages and objects of the present invention will become more apparent from the following description, claims and drawings in which:

BRIEF DESCRIPTION OF THE DRAWINGS

FIG. 1 is a partial cross-sectional view of a boat having the exhaust system of the present invention installed therein;

FIG. 2 is a detailed perspective view of the interior of a portion of the stern of the boat with the exhaust chamber partially broken away to illustrate the details thereof; and FIG. 3 is a detail perspective view of the underside of the hull and the stern area of a boat showing the exhaust opening which is submerged when the boat is in operation.

DETAILED DESCRIPTION OF THE INVENTION

Referring now to the drawings, FIG. 1 shows a conventional power boat 10 having hull 11 within which is mounted a marine internal combustion engine 12. The engine 12 drives a propeller or screw, now shown, of conventional construction. The products of combustion and exhaust gases emitted during operaton of engine 12 are collected in exhaust manifold 14 and conducted to exhaust chamber 20 through exhaust pipe 16.

Exhaust chamber 20 is shown in greater detail in FIGS. 2 and 3. Exhaust chamber 20 is generally rectangular having top wall 22, bottom wall 24 and opposite end walls 26 and 28. Opposite side walls 29 and 30 complete chamber 20. Although exhaust chamber 20 may be formed as a separate unit and mounted within the boat at a convenient location; it is preferred that chamber 20 be formed in place during construction of the boat. In this way end wall 28 can be formed as a common wall with the transom 31 of the boat. Similarly, inner side wall 30 and bottom wall 24 can both be formed as a common wall with a portion of the hull. Chamber 20 can be of any suitable corrosion-resistant material, as for example Fiberglas.

End wall 26 is provided with a circular fitting or coupling 32 which communicates with the interior 33 of chamber 20 for attachment to exhaust pipe 16 by means of a conventional clamp 35. An annular ring 36 is provided in top wall 22 at a central location. The annular ring 36 is threaded to accept a removable cover plate 38 which is in threaded engagement with ring 36. Access to interior 33 of chamber 20 can be gained by removal of plate 38 if it becomes necessary to clean out chamber 20 or for repair of the chamber. For example, if the boat is operated in salt water over a period of time, it is possible that barnacles could occur in the chamber and periodic cleaning may be necessary.

The end wall 28 of chamber 20 is shown as common with the transom 31 of the boat. End wall 28 is provided with one or more vent holes 40 which communicate the chamber interior 33 with atmosphere. As seen in FIG. 1, the vent holes are located at an elevation above the normal water line of the boat 10. In this way, when the boat 10 is idling or moving at a slow speed, exhaust gases will escape from chamber 20 directly to the atmosphere via vent openings 40. The vent holes should have a total area less than the cross-sectional area of exhaust pipe 16 which is connected to chamber 20.

The bottom wall 24 of chamber 20 which is formed by a part of the hull of the boat is provided with an exhaust port 44 which discharges below the water line. Exhaust port 44 has a generally rectangular configuration 46 in the underside of the hull 10. A flange or plate 48 is forwardly inclined into chamber interior 33 from the rear of rectangular opening 46. Opposite generally triangular shaped side members 50 extend between the flange 48 and the opposite sides of the port 46 to form an exhaust channel. An opening 52 which is, in effect, recessed above the underside of the hull communicates with the interior 33 of exhaust chamber 20 at the forward end of exhaust channel 47. Opening 52 may be of any desired configuration but should approximate in area the cross-sectional area of exhaust pipe 16.

In operation, the exhaust gases from engine 12 are conducted to the interior 33 of exhaust chamber 20 by exhaust pipe 16. If the boat 10 is not in motion and is idling or is operating at a very low speed, exhaust gases will not be discharged at port 44 due to the inability of the exhaust gases to act against the water pressure of the submerged port 44. Rather, the exhaust gases will be discharged directly to atmosphere through vent holes 40. At idling conditions or low operating speed, the volume of exhaust gases are reduced and noise levels are similarly reduced so as to make atmospheric discharge not objectionable.

When the boat is underway, there will exist a relative movement of water across port 44. Exhaust gases will be allowed to escape beneath the water with the flow of water facilitating with exit of gases from the chamber. In effect a vacuum is created at opening 52 drawing gases from the chamber interior 33 through channel 47. The discharge of the gases below the surface of the water will serve to silence the operation of the engine and will also prevent any noxious fumes from bothering the occupants or operator of the boat. The precise exhaust flow pattern within the exhaust chamber 20 is not known. However, substantial turbulence occurs in the chamber and expansion and cooling of gases also occurs. The relatively large volume of the chamber, which is at least partially filled with water, serves to dampen and silence the noise due to both the exhaust gas velocity and mechanical engine noise transmitted through the exhaust.

The present invention has a number of substantial advantages and results in reduced back pressure in the exhaust system when the engine is idling or operating at a low speed. Increased back pressure can cause a number of undesirable problems including formation of excessive carbon deposits in the engine. Back pressure may also increase operating temperature to levels which accelerate wear and inhibit performance of the engine.

In order to prove the advantages of the present invention, a boat was equipped with the exhaust system described herein. The following example is by way of illustration of the present invention and not by way of limitation. In carrying out the invention, a 30 foot inboard with a V-hull configuration was equipped with the exhaust system of the present invention. The boat was powered by twin 233 horsepower Mercury V-8 marine engines. The exhaust manifolds were connected by a 4 inch exhaust line to the coupling 32 of an exhaust chamber 20. Chamber 20 was formed of Fiberglas as an integral part of the boat construction as shown in FIG. 2. The dimensions of the chamber were approximately 15 inches wide by 18 inches long by 15 inches high having an approximate volumetric capacity of 3000 cubic inches. An exhaust port 44 was formed opening into chamber interior 33 with the dimensions of port 46 being approximately 8 inches wide and 6 inches long. The exhaust opening 52 was in the form of a generally circular opening approximately 3¾ inches in diameter. Vent holes 40 were provided in the common end wall-transom of the boat, three being provided each circular and all having a diameter of approximately ½ inch.

The system worked extremely well and although comparative sound level readings were not taken, a noticeable reduction in noise occurred throughout the operating range. No power loss or reduction in performance was noted.

It will be obvious to those skilled in the art to make various alterations, changes and modifications to the device of the present invention. To the extent that these alterations, changes and modifications do not depart from the spirit and scope of the appended claims, they are intended to be encompassed therein.

I claim:

1. An exhaust system for a boat powered by an internal combustion engine having an exhaust pipe, said boat having a hull including a hull surface normally submerged below the water level, said system comprising:

a. a chamber located within the hull including inlet means located above the normal water level and adapted to be connected to the exhaust pipe of the internal combustion engine;

b. exhaust vent means communicating the interior of said chamber with atmosphere, said vent means located at a location normally above the water level; and c. exhaust port means communicating said chamber interior with a location below the normal water level, said exhaust port means including a recess in said hull surface, said recess having a surface extending generally forwardly and upwardly in said hull surface, said recess defining an opening at a generally forward location therein and spaced upwardly from the plane of said hull surface, whereby exhaust is permitted to excape from said chamber at said exhaust vent means when said boat is idling and whereby exhaust is drawn from said exhaust chamber under the influence of water flow at said port when said boat is underway thereby reducing exhaust noise.

2. The exhaust system of claim 1, wherein said chamber has a top wall, a bottom wall, opposite end walls and opposite side walls and wherein said chamber is integrally formed as a part of the hull with the bottom wall and one of said end walls common with the hull.

3. The exhaust system of claim 1, wherein said surface is forwardly inclined.

* * * * *